US009135801B2

(12) United States Patent
Hatsir

(10) Patent No.: US 9,135,801 B2
(45) Date of Patent: Sep. 15, 2015

(54) FULLY MECHANICAL PNEUMATIC EXCESSIVE HEAT OR/AND FIRE LINE-TYPE DETECTOR, AND SYSTEM, METHODS, APPLICATIONS THEREOF

(71) Applicant: FireSys Ltd., Kibbutz Lehavot HaBasham (IL)

(72) Inventor: Eli Hatsir, Kibbutz Lehavot HaBashan (IL)

(73) Assignee: FireSys Ltd., Kibbutz Lehavot HaBasham (IL)

( * ) Notice: Subject to any disclaimer, the term of this patent is extended or adjusted under 35 U.S.C. 154(b) by 117 days.

(21) Appl. No.: 14/082,225

(22) Filed: Nov. 18, 2013

(65) Prior Publication Data

US 2015/0137980 A1 May 21, 2015

(51) Int. Cl.
*G08B 17/00* (2006.01)
*G08B 17/04* (2006.01)

(52) U.S. Cl.
CPC ..... *G08B 17/04* (2013.01)

(58) Field of Classification Search
CPC ..... G01S 17/88; G01S 17/89; G01S 7/417; G01S 7/4802; G01S 7/539; G01S 15/42; G01S 17/026; G06K 9/00624; G06K 9/00832; G06K 9/00362; B60C 11/24; B60C 19/00; B60J 7/0573; B60Q 1/143
USPC ..... 340/584, 630, 628, 627, 603, 629, 588, 340/632, 635, 595, 501, 517, 521
See application file for complete search history.

(56) References Cited

U.S. PATENT DOCUMENTS 4,760,379 A * 7/1988 De Phillipo et al. ..... 340/507
4,812,821 A * 3/1989 Santy et al. ..... 340/538
6,039,124 A * 3/2000 Bowman et al. ..... 169/61
6,121,883 A * 9/2000 Hatsir ..... 340/584
6,333,689 B1 * 12/2001 Young ..... 340/506

OTHER PUBLICATIONS

Firetrace "Protecting Your Microenvironment", Firetrace International LLC, Scotsdale, AZ, USA, Technical Information, From Official Website, 2 P., Accessed During Oct. 2013.
Fogmaker "Teknik", Fogmaker International AB, Vaxjo, Sweden, Technical Information, From Official Website, 1 P., Accessed During Oct. 2013.
Meggitt "Fire and Overheat Detection", Meggitt Safety Systems Inc., Simi Valley, CA, USA Technical Information, From Official Website, 2 P., Accessed During Oct. 2013.

* cited by examiner

*Primary Examiner* — Daniel Previl

(57) ABSTRACT

A fully mechanical pneumatic line-type excessive heat or/and fire detector, and, system, methods, and applications thereof, for detecting and warning of conditions of excessive heat or/and fire. The detector includes a detector testing switch apparatus for testing operable condition and status of the excessive heat or/and fire detector, and is operatively connectable to an externally located system control device, as an overall detection system. The detector is automatically or manually activated. The system includes the excessive heat or/and fire detector. Detector and system are configured and operable according to rate of temperature rise or/and fixed temperature type detection modes. Applicable in a wide variety of environments, such as of vehicle engines or machine, which may involve generation of excessive heat or/and fire, where there is need to detect and warn of a condition of excessive heat or/and fire, in a practical, reliable, robust, and cost effective manner.

25 Claims, 7 Drawing Sheets

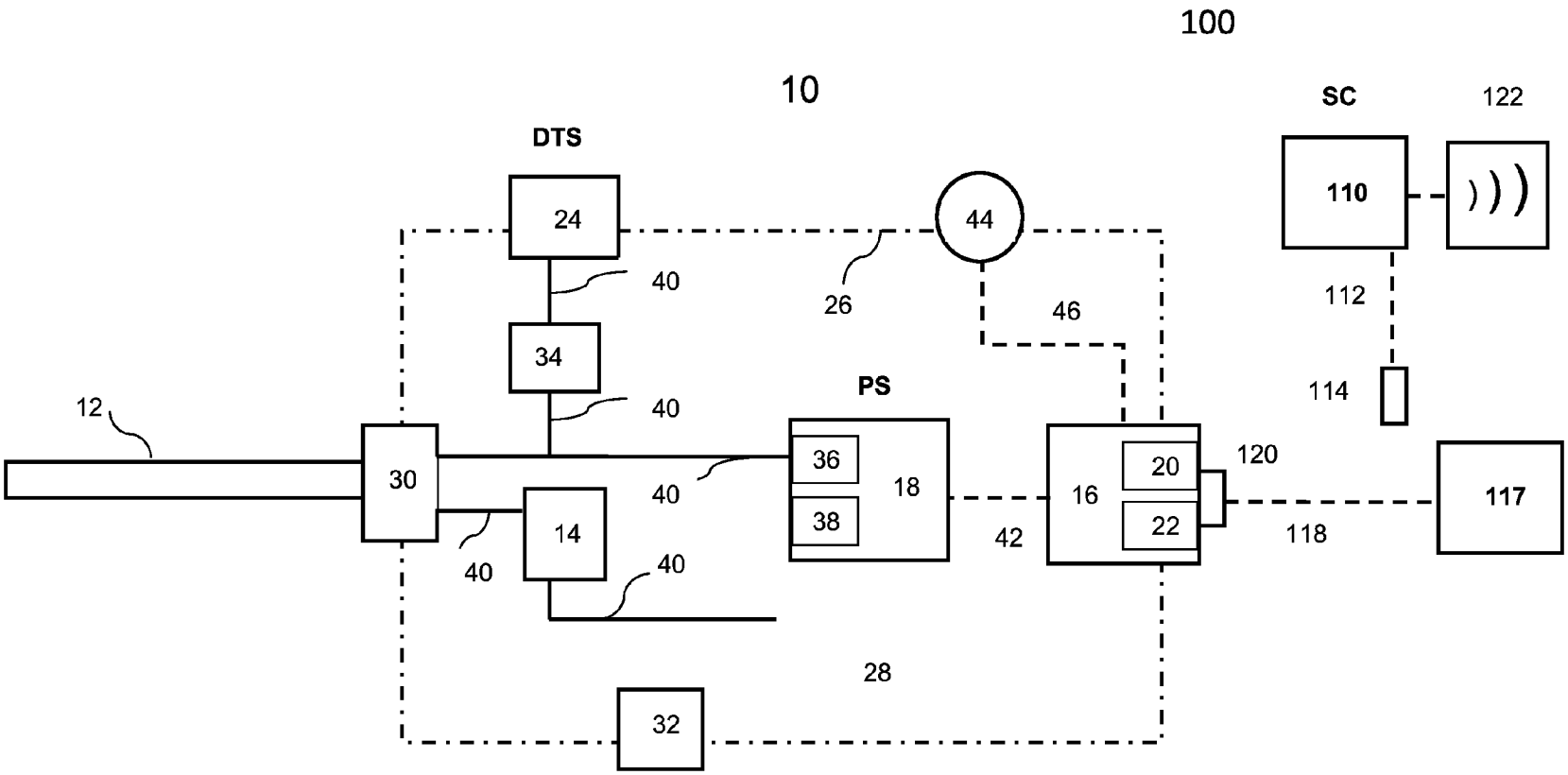
FIG. 3 (detector testing using external VOM meter)

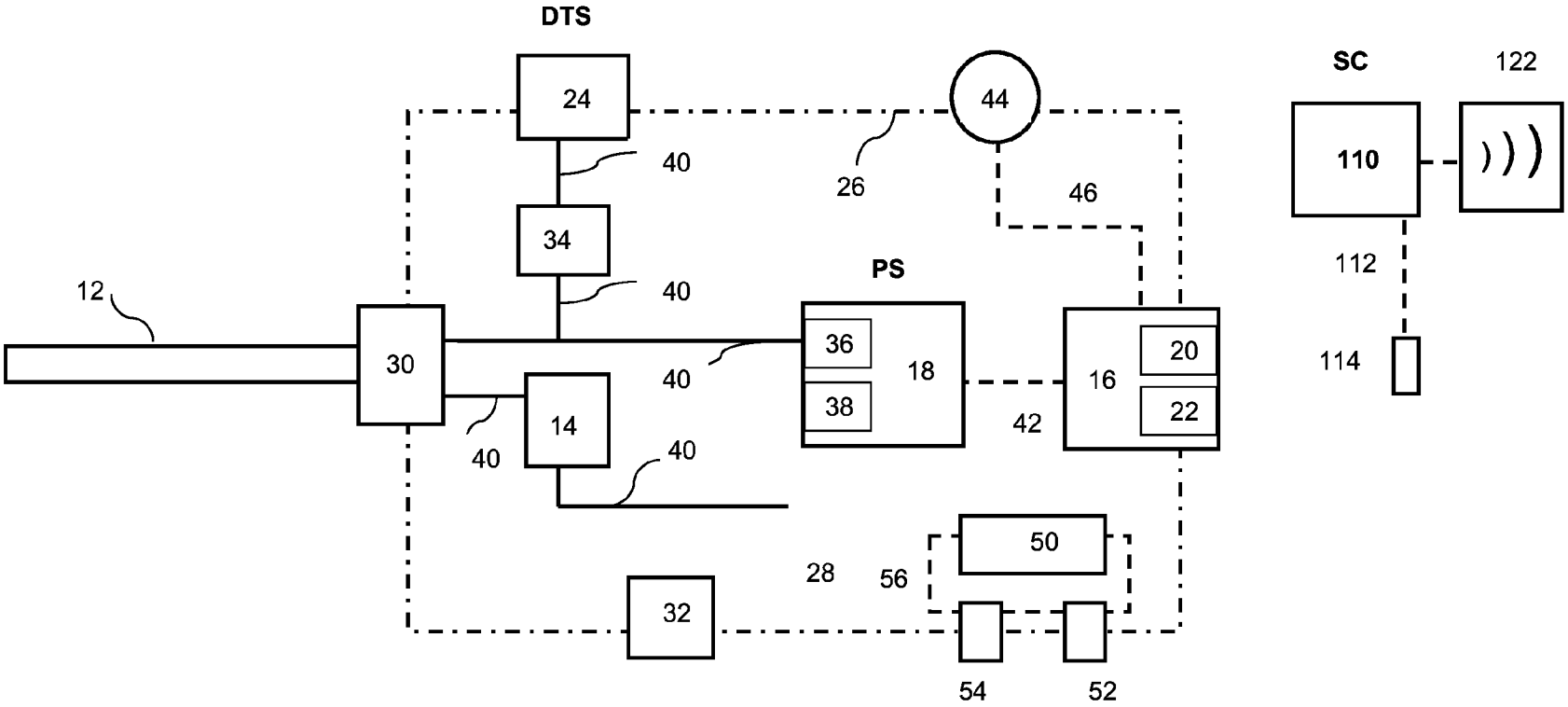
FIG. 4 (detector testing using internal battery and indicators)

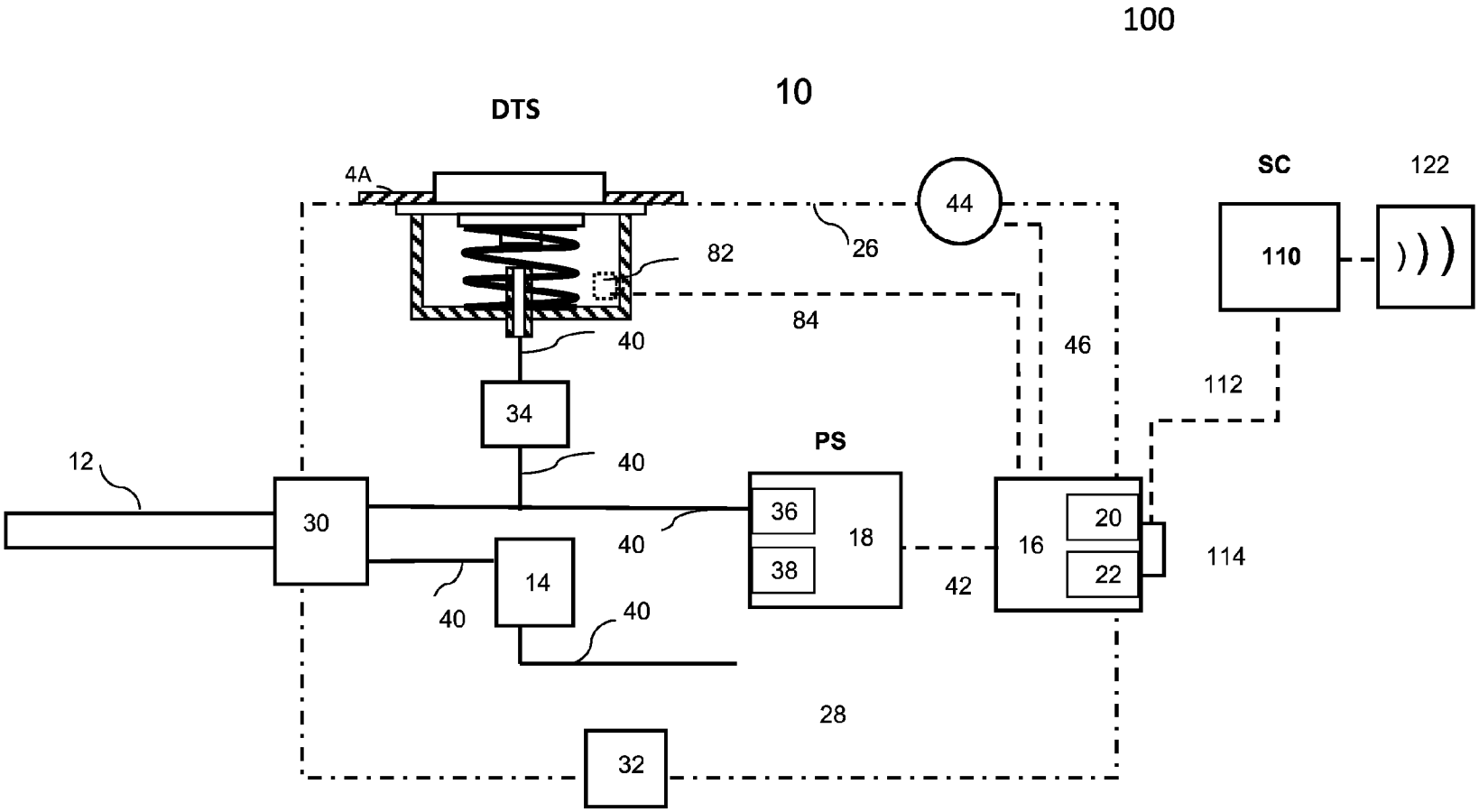
FIG. 5 (detector testing using external power supply and micro-heater)

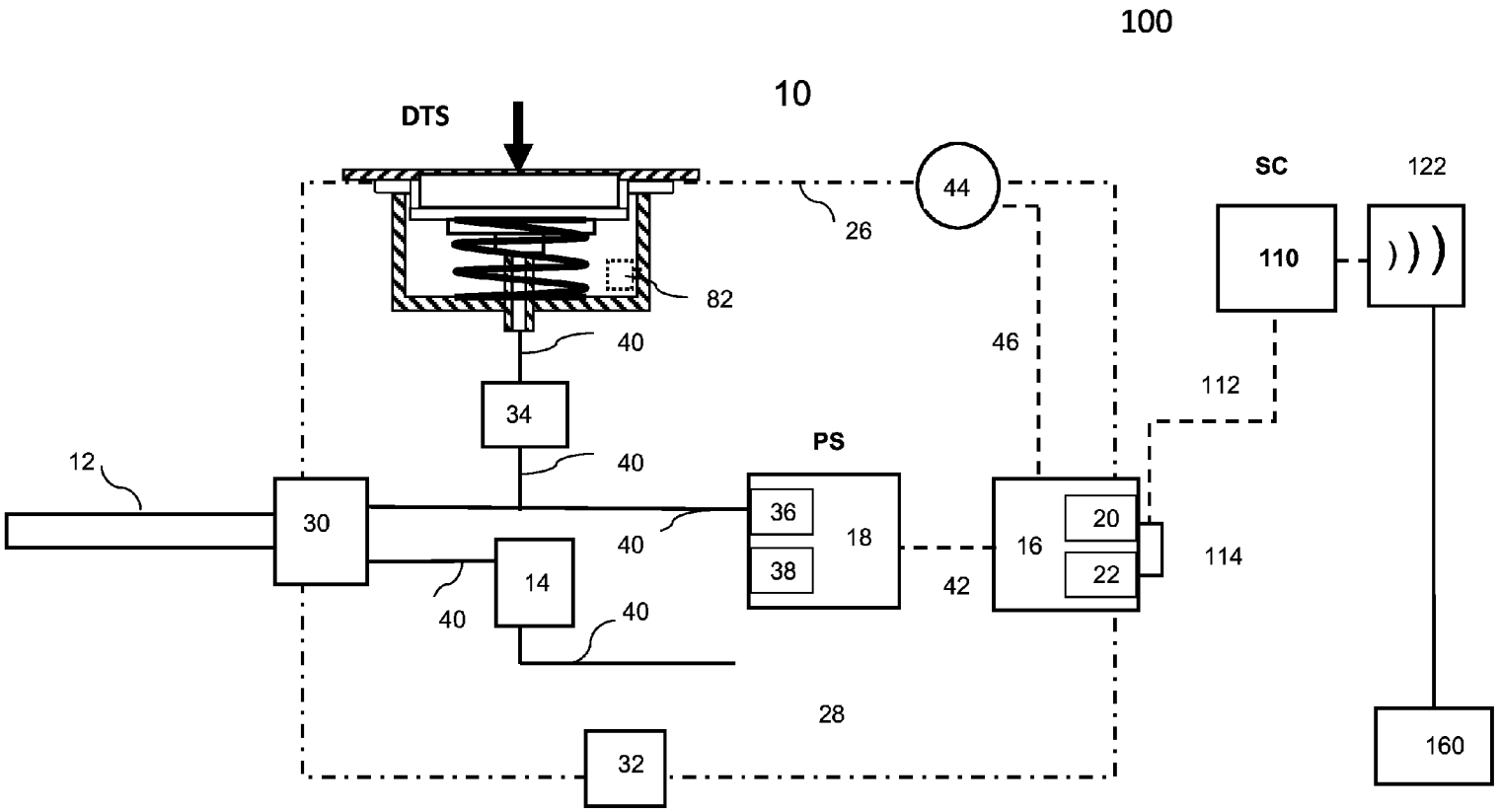
FIG. 6 (manual system activation)

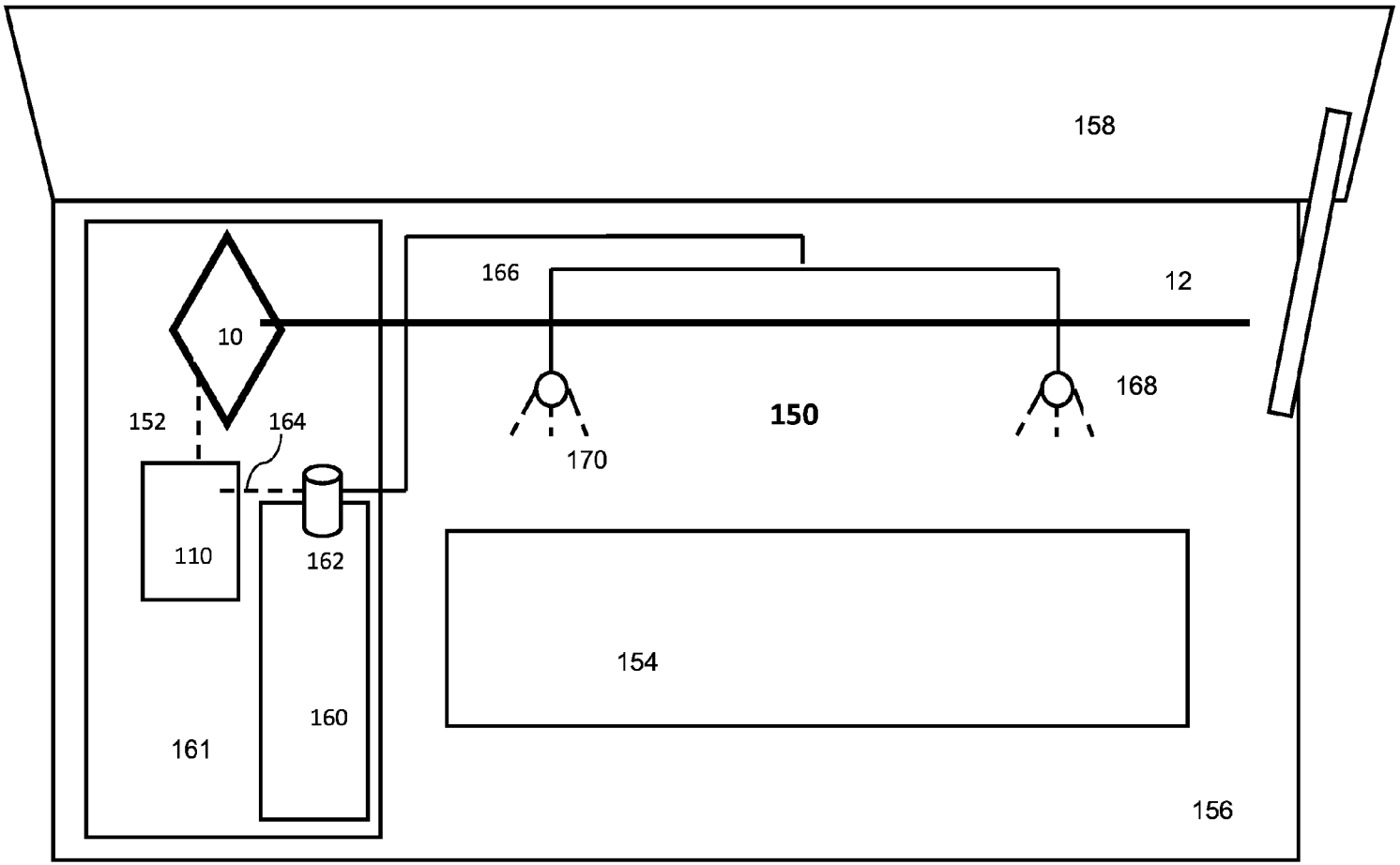
FIG. 7 (exemplary detector installation in vehicle engine or machine)

FULLY MECHANICAL PNEUMATIC EXCESSIVE HEAT OR/AND FIRE LINE-TYPE DETECTOR, AND SYSTEM, METHODS, APPLICATIONS THEREOF

FIELD AND BACKGROUND OF THE INVENTION

The present invention, in some embodiments thereof, relates to automatic excessive heat or/and fire detection, and more particularly, but not exclusively, to a fully mechanical pneumatic line-type excessive heat or/and fire detector, and, system, methods, and applications thereof, for detecting and warning of a condition of excessive heat or/and fire.

Automatic heat detection methods, devices, and systems are implemented for detecting spontaneous occurrence of overheating or excessive heat generation in general, and in particular, when the heat is associated with or caused by a fire. Currently used methods and equipment for automatically detecting a fire are based on detecting different phenomena related to the fire, such as the presence of smoke, radiation, or excessive heat. A first example involves detecting the presence of smoke, by a smoke detector, as the result of something burning, which is normally quite effective for indirectly indicating the presence of a fire. A second example involves detecting radiation emitted by the flames of a fire, by radiation absorption or electro-optical techniques, which are also effective for indirectly indicating the presence of a fire. A third example, involves detecting the occurrence of excessive heat, by a heat detector, directly associated with and at the location of the fire itself, or, caused by the fire but at a distance from the actual fire.

A given fire detector operating with a fire detection mechanism for detecting a fire according to one of the above described types of fire-related phenomena is limited to the design and operation of that particular fire detection mechanism. For example, a smoke detector features a smoke detection mechanism for detecting the presence of smoke, which is not designed for, nor capable of, detecting other fire-related phenomena of radiation or excessive heat. A radiation detector features a radiation detection mechanism for detecting emitted radiation, which is not designed for, nor capable of, detecting smoke or excessive heat. Similarly, a heat detector features a heat detection mechanism for detecting excessive heat, which is not designed for, nor capable of, detecting smoke or radiation. Each type of fire detector has particular advantages and disadvantages, usually defined by the characteristics, requirements, and environmental conditions of a particular fire detection application.

Extensive background information relating to automatic excessive heat or/and fire detection methods, devices, and systems, and, principles and practices thereof, which are implemented for detecting spontaneous occurrence of overheating or excessive heat generation in general, and in particular, when the heat is associated with or caused by a fire, is provided in same applicant's U.S. Pat. No. 6,121,883, the contents of which are incorporated by reference as if fully set forth herein in their entirety.

Pneumatic Non-Electronic Line-Type Fire Detector Devices

Currently used devices in this category are based on a pneumatic line-type plastic tubing which is designed to rupture when directly exposed to flames of a fire. The tubing is filled with air or nitrogen. Breaking or rupturing of the tubing allows immediate decrease of the pressure inside the tube. This is recognized by a system control unit as a condition of fire detection. A reservoir having a specified pressure must be connected and monitored for leakage. The tubing includes many fittings that may cause problems. Additionally, for such detectors, the tubing typically degrades when exposed to high temperatures or sunlight radiation. Such detectors are non-restorable (i.e., disposable) which must be replaced after a fire event takes place. Another problem associated with this type of detector is that after installation of an overall fire detection system including such a line-type detector, a user cannot test detection capability of the system. Currently used pneumatic non-electronic line-type fire detectors are not designed to sense, and therefore, detect, heat from a distance, and in practice, the tubing needs to be directly exposed to, and make contact with, flames in order to rupture. Additionally, despite absence of a fire, leakage in the tubing or/and tube fittings will cause 'false' alarms, often accompanied by 'falsely' activating fire extinguishing equipment.

Thermal Non-Electronic Line-Type Fire Detector Devices

Another type of detector device is a heat sensitive plastic cable corresponding to a bundle of powder coated twisted metal wires. Once the wires are exposed to fire, the isolation coating melts and contact is achieved between the wires. This type of detector is simple but also has limitations, such as not being designed to sense heat from a distance, and in practice, the wires need to be directly exposed to, and make contact with, flames in order to melt the coating for signaling a condition or event of fire. This type of detector is also non-restorable (i.e., disposable) which must be replaced after a fire event takes place. Here too, after installation of an overall fire detection system including such a line-type detector, a user cannot test detection capability of the system. Additionally, the powder coating is fragile and can easily be damaged when exposed to harsh environmental conditions. Additionally, despite absence of a fire, mechanical damage to the cable may cause short circuiting of the wires, which, in turn, will cause 'false' alarms, often accompanied by 'falsely' activating fire extinguishing equipment.

In spite of extensive teachings in the field and art of automatic excessive heat or/and fire detection, there is an ongoing need for developing and practicing improved or/and new techniques thereof.

Thus, it would be highly advantageous and useful to have automatic excessive heat or/and fire detection apparatuses, methods, and applications, thereof, which address and overcome at least some of currently existing problems, disadvantages, or/and limitations in the field and art of automatic excessive heat or/and fire detection. More particularly, but not exclusively, it would be highly advantageous and useful to have a fully mechanical pneumatic line-type excessive heat or/and fire detector, and, system, methods, and applications thereof, for detecting and warning of a condition of excessive heat or/and fire. It would also be advantageous and useful to have such an invention which may be implemented in a wide variety of numerous applications which involve, or potentially involve, generation of excessive heat or/and fire, and where there is need to detect and warn of a condition of excessive heat or/and fire, in a practical, reliable, robust, and cost effective manner.

SUMMARY OF THE INVENTION

The present invention, in some embodiments thereof, relates to automatic excessive heat or/and fire detection, and more particularly, but not exclusively, to a fully mechanical pneumatic line-type excessive heat or/and fire detector, and, system, methods, and applications thereof, for detecting and warning of a condition of excessive heat or/and fire.

The detector includes a detector testing switch apparatus for testing operable condition and status of the excessive heat or/and fire detector, and is operatively connectable to an externally located system control device, for example, configured as an overall excessive heat or/and fire detection system. The detector is readily calibrated according to particular needs and applications, and may be automatically or manually activated. The system includes the excessive heat or/and fire detector.

According to some embodiments, the excessive heat or/and fire detector is (structurally and functionally/operationally) configured according to a rate of temperature rise type detection configuration or mode of operation, or/and, according to a fixed temperature type detection configuration or mode of operation. According to such embodiments, similarly, the system is (structurally and functionally/operationally) configured according to a rate of temperature rise type detection configuration or mode of operation, or/and, according to a fixed temperature type detection configuration or mode of operation. Accordingly, the detector, and the system, may be configured according to either one type or both types of detection configuration or mode of operation.

Embodiments of the present invention may be implemented in a wide variety of numerous applications, such as of vehicle engines or machines (such as machine motors or components thereof), which involve, or potentially involve, generation of excessive heat or/and fire, and where there is need to detect and warn of a condition of excessive heat or/and fire, in a practical, reliable, robust, and cost effective manner.

Some embodiments of the present invention address and overcome at least some of currently existing problems, disadvantages, or/and limitations in the field and art of automatic excessive heat or/and fire detection.

According to an aspect of some embodiments of the present invention, there is provided a device for detecting excessive heat or/and fire, the detector device comprising: closed line-type tube containing a gaseous fluid whose pressure is responsive to variations in temperature, for detecting and sensing a potential condition of excessive heat or/and fire; a fluid flow restrictor connected to the closed line-type tube, and in fluid communication with the closed line-type tube fluid and surrounding atmosphere; a pressure switch connected to the closed line-type tube and in fluid communication with the closed line-type tube fluid, and within which a pressure difference is produced in response to a change in pressure of the closed line-type tube fluid; a detector external connector assembly connected to the pressure switch and connectable to an external control device, and having electrical contacts configured for contacting each other when the pressure difference in the pressure switch exceeds a threshold value, for actuating the external control device; and a detector testing switch connected between the closed line-type tube and the pressure switch, in fluid communication with the closed line-type tube fluid, and manually operable for generating a pressure pulse in the detector, for testing operable condition and status of the detector.

According to some embodiments of the invention, in the detector device, the closed line-type tube is constructed of metallic material.

According to some embodiments of the invention, the detector device further comprises a detector housing for housing components of the detector device.

According to some embodiments of the invention, the detector device further comprises a tube connection adaptor, for enabling connection and disconnection of the closed line-type tube to and from the detector.

According to some embodiments of the invention, the detector device further comprises a pressure balancing/equalizing element, in fluid communication with the fluid and surrounding atmosphere, and configured for balancing/equalizing the fluid pressure with pressure of surrounding atmosphere.

According to some embodiments of the invention, in the detector device, the pressure balancing/equalizing element is configured along, and through, a wall of a detector housing.

According to some embodiments of the invention, the detector device further comprises a second fluid flow restrictor, configured between the detector testing switch and the pressure switch, and in fluid communication with the closed line-type tube fluid, for restricting fluid flow therebetween.

According to some embodiments of the invention, in the detector device, the pressure switch includes a high pressure port and a low pressure port.

According to some embodiments of the invention, in the detector device, the detector testing switch is configured for being operable in a temperature range of from about minus forty degrees Celsius (−40° C.) to about plus one-hundred and twenty-five degrees Celsius (+125° C.).

According to some embodiments of the invention, the detector device further comprises a fixed temperature thermal switch, connected to the detector external connector assembly, for use when the detector operates according to a fixed temperature type detection configuration or mode of operation.

According to some embodiments of the invention, in the detector device, the detector testing switch comprises: a closed housing containing a gaseous fluid and whose top side is configured with a diaphragm sealing element; a releasably pushable button assembly affixed upon and through the diaphragm sealing element; a spring or spring-like element contained inside the housing, and whose first end is affixed to the push button assembly and whose second end is affixed to bottom side of the housing; and a fluid duct affixed along and through the bottom side of the closed housing; whereby pushing the button assembly increases pressure of the gaseous fluid inside the closed housing, and generates a pressure pulse directed through the fluid duct and into the excessive heat or/and fire detector.

According to some embodiments of the invention, in the detector device, the fluid duct is a duct through which the gaseous fluid is directed and passes from inside of the closed housing and through the detector fluid flow restrictor.

According to some embodiments of the invention, in the detector device, the detector testing switch includes a microheater, connectable to, and actuatable by, the external control device.

By way of the detector testing switch being a main component of the fully mechanical pneumatic type detector for detecting excessive heat or/and fire, some embodiments of the present invention also feature an apparatus, corresponding to the detector testing switch, for testing operable condition and status of the excessive heat or/and fire detector.

Thus, according to another aspect of some embodiments of the present invention, there is provided an apparatus for testing operable condition and status of an excessive heat or/and fire detector, the apparatus comprising: a closed housing containing a gaseous fluid (for example, air) and whose top side is configured with a diaphragm sealing element; a releasably pushable button assembly affixed upon and through the diaphragm sealing element; a spring or spring-like element contained inside the closed housing, and whose first end is affixed to the push button assembly and whose second end is affixed to bottom side of the housing; and a fluid duct affixed along and through the bottom side of the housing; whereby pushing the button assembly increases pressure of the gaseous fluid inside the housing, and generates a pressure pulse directed through the fluid duct and into the excessive heat or/and fire detector.

According to some embodiments of the invention, in the detector testing switch apparatus, the fluid duct is a duct through which the gaseous fluid is directed and passes from inside of the closed housing and through a fluid flow restrictor.

According to some embodiments of the invention, in the detector testing switch apparatus, the diaphragm sealing element spans a distance (diameter) of about thirty millimeters (30 mm).

According to some embodiments of the invention, in the detector testing switch apparatus, the bottom side of closed housing spans a distance (diameter) of about twenty millimeters (20 mm).

According to some embodiments of the invention, in the detector testing switch apparatus, the bottom side of the closed housing to top side of the releasably pushable button assembly spans a distance (height) of about twenty millimeters (20 mm).

According to some embodiments of the invention, in the detector testing switch apparatus, the closed housing is configured from an engineered type plastic.

According to some embodiments of the invention, in the detector testing switch apparatus, the spring or spring-like element is configured and operable for being flexible, and contractable/expandable inside the closed housing.

According to some embodiments of the invention, in the detector testing switch apparatus, the spring or spring-like element is constructed from a flexible (contractable/expandable) metallic material.

According to some embodiments of the invention, in the detector testing switch apparatus, the spring or spring-like element is configured and operable such that the apparatus is capable of generating a pressure pulse within a pre-determined range characterized by a pre-determined lower limit pressure pulse and a pre-determined upper limit pressure pulse.

According to some embodiments of the invention, in the detector testing switch apparatus, the fluid duct is configured for being connected to a fluid flow restrictor via tubing having a length in a range of from about five centimeters (5 cm) to about ten centimeters (10 cm).

According to another aspect of some embodiments of the present invention, there is provided a system for detecting excessive heat or/and fire, the detector system comprising: a detector device comprising: a closed line-type tube containing a gaseous fluid whose pressure is responsive to variations in temperature, for detecting and sensing a potential condition of excessive heat or/and fire; a fluid flow restrictor connected to the closed line-type tube, and in fluid communication with the closed line-type tube fluid and surrounding atmosphere; a pressure switch connected to the closed line-type tube and in fluid communication with the closed line-type tube fluid, and within which a pressure difference is produced in response to a change in pressure of the closed line-type tube fluid; a detector external connector assembly connected to the pressure switch and connectable to an external control device, and having electrical contacts configured for contacting each other when the pressure difference in the pressure switch exceeds a threshold value, for actuating the external control device; and a detector testing switch connected between the closed line-type tube and the pressure switch, in fluid communication with the closed line-type tube fluid, and manually operable for generating a pressure pulse in the device, for testing operable condition and status of the detector device, and for manually activating the detector device; and a system control device operatively connected to, and in electrical communication with, the detector device.

According to some embodiments of the invention, in the detector system, the detector testing switch comprises: a closed housing containing a gaseous fluid and whose top side is configured with a diaphragm sealing element; a releasably pushable button assembly affixed upon and through the diaphragm sealing element; a spring or spring-like element contained inside the housing, and whose first end is affixed to the push button assembly and whose second end is affixed to bottom side of the housing; and a fluid duct affixed along and through the bottom side of the closed housing; whereby pushing the button assembly increases pressure of the gaseous fluid inside the closed housing, and generates a pressure pulse directed through the fluid duct and into the detector device.

All technical and/or scientific words, terms, or/and phrases, used herein throughout the present disclosure have the same or similar meaning as commonly understood by one of ordinary skill in the art to which the invention pertains, unless otherwise specifically defined or stated herein. Although materials or/and methods equivalent or similar to those described herein can be used in practicing or/and testing embodiments of the invention, exemplary materials or/and methods are described below. In case of conflict, the patent specification, including definitions, will control. In addition, materials, methods, and examples described herein are illustrative only and are not intended to be necessarily limiting.

Implementation of some embodiments of the invention can involve performing or completing selected tasks manually, automatically, or a combination thereof. Moreover, according to actual instrumentation and equipment of embodiments of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the present invention are herein described, by way of example only, with reference to the accompanying drawings. With specific reference now to the drawings in detail, it is stressed that the particulars shown are by way of example and for purposes of illustrative description of some embodiments of the present invention. In this regard, the description taken together with the accompanying drawings make apparent to those skilled in the art how some embodiments of the present invention may be practiced.

In the drawings:

FIG. 3 is a schematic diagram illustrating an exemplary embodiment of testing the detector (10) using an externally located detector testing mechanism (116, 117), as part of exemplary overall system (100) for detecting excessive heat or/and fire, in accordance with some embodiments of the present invention;

FIG. 4 is a schematic diagram illustrating an exemplary embodiment of testing the detector (10) using an internally located detector testing mechanism (48 [50, 52, 54]), as part of exemplary overall system (100) for detecting excessive heat or/and fire, in accordance with some embodiments of the present invention;

FIG. 5 is a schematic diagram illustrating an exemplary embodiment of testing the detector (10) using an internally located micro-heater (82) of detector (10) and an externally located power source ([SC] (110), as part of exemplary overall system (100) for detecting excessive heat or/and fire, in accordance with some embodiments of the present invention;

FIG. 6 is a schematic diagram illustrating an exemplary embodiment of manual operation of the detector (10), via detector testing switch [DTS] (24), for manually activating exemplary overall system (100) for detecting excessive heat or/and fire, in accordance with some embodiments of the present invention; and FIG. 7 is a schematic diagram illustrating an exemplary embodiment of installation of the detector (10) for detecting excessive heat or/and fire, as part of an exemplary embodiment of an exemplary overall system (150) for detecting excessive heat or/and fire of a vehicle engine or of a machine, in accordance with some embodiments of the present invention.

DESCRIPTION OF SPECIFIC EMBODIMENTS OF THE INVENTION

Figure 1:
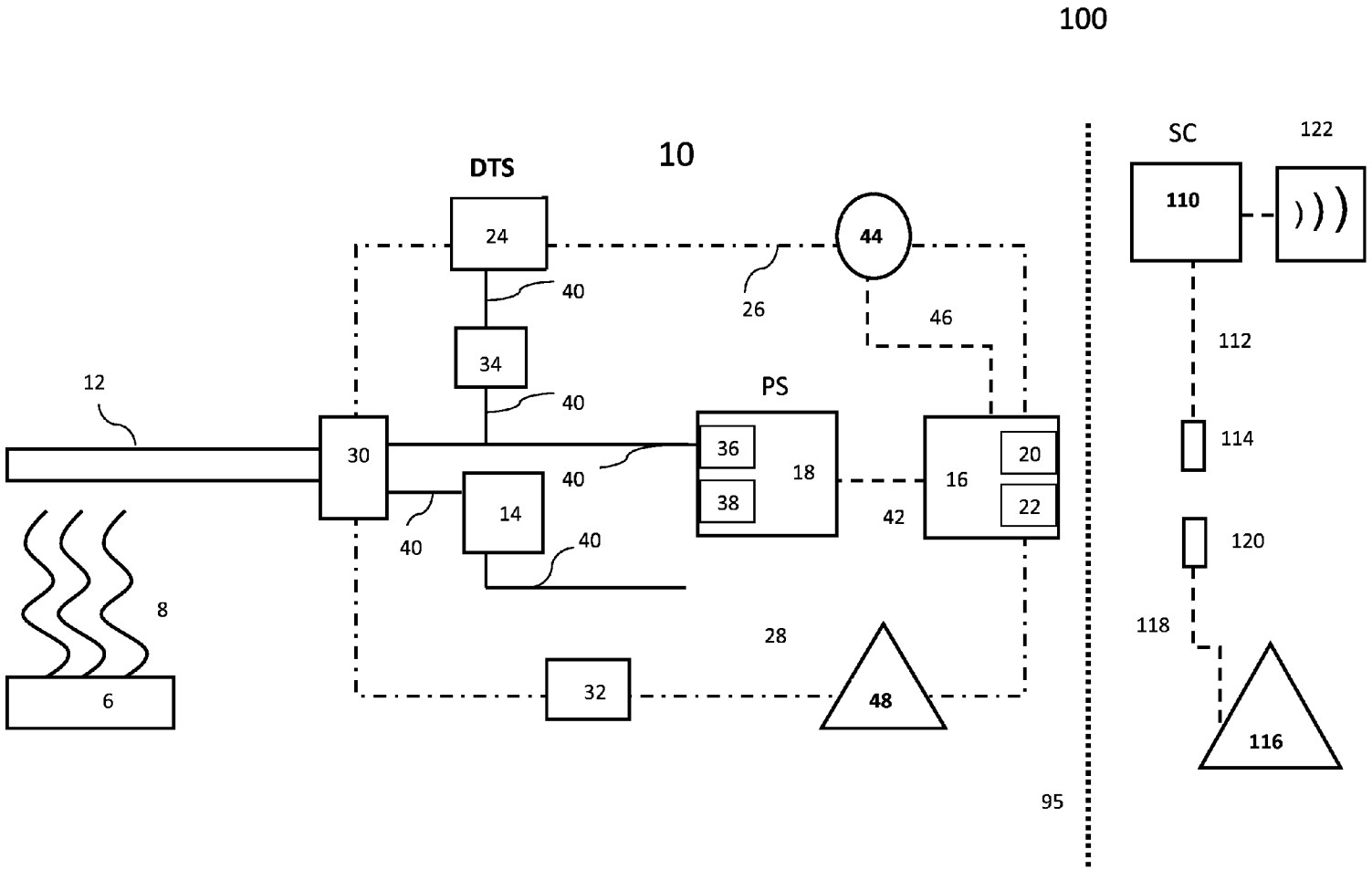
FIG. 1 is a schematic diagram illustrating an exemplary embodiment of the detector (10) for detecting excessive heat or/and fire, shown as part of an exemplary embodiment of an overall system (100) for detecting excessive heat or/and fire, in accordance with some embodiments of the present invention.

The present invention, in some embodiments thereof, relates to automatic excessive heat or/and fire detection, and more particularly, but not exclusively, to a fully mechanical pneumatic line-type excessive heat or/and fire detector, and, system, methods, and applications thereof, for detecting and warning of a condition of excessive heat or/and fire.

The detector includes a detector testing switch apparatus for testing operable condition and status of the excessive heat or/and fire detector, and is operatively connectable to an externally located system control device, for example, configured as an overall excessive heat or/and fire detection system. The detector is readily calibrated according to particular needs and applications, and may be automatically or manually activated. The system includes the excessive heat or/and fire detector.

According to some embodiments, the excessive heat or/and fire detector is (structurally and functionally/operationally) configured according to a rate of temperature rise type detection configuration or mode of operation, or/and, according to a fixed temperature type detection configuration or mode of operation. According to such embodiments, similarly, the system is (structurally and functionally/operationally) configured according to a rate of temperature rise type detection configuration or mode of operation, or/and, according to a fixed temperature type detection configuration or mode of operation. Accordingly, the detector, and the system, may be configured according to either one type or both types of detection configuration or mode of operation.

Embodiments of the present invention may be implemented in a wide variety of numerous applications, such as of vehicle engines or machines (such as machine motors or components thereof), which involve, or potentially involve, generation of excessive heat or/and fire, and where there is need to detect and warn of a condition of excessive heat or/and fire, in a practical, reliable, robust, and cost effective manner.

An aspect of some embodiments of the present invention is a device for detecting excessive heat or/and fire, being a fully mechanical pneumatic line-type detector for detecting excessive heat or/and fire, herein, also referred to as the excessive heat or/and fire detector, and, for brevity, also referred to as the detector.

In some embodiments, the detector for detecting excessive heat or/and fire includes the following main structural and functional components, features, and characteristics: a closed line-type tube containing a gaseous fluid (for example, air) whose pressure is responsive to variations in temperature, for detecting and sensing a potential condition of excessive heat or/and fire; a fluid flow restrictor connected to the closed line-type tube, and in fluid communication with the closed line-type tube fluid and surrounding atmosphere; a pressure switch connected to the closed line-type tube and in fluid communication with the closed line-type tube fluid, and within which a pressure difference is produced in response to a change in pressure of the closed line-type tube fluid; a detector external connector assembly connected to the pressure switch and connectable to an external control device, and having electrical contacts configured for contacting each other when the pressure difference in the pressure switch exceeds a threshold value, for actuating the external control device; and a detector testing switch connected between the closed line-type tube and the pressure switch, in fluid communication with the closed line-type tube fluid, and manually operable for generating a pressure pulse in the detector, for testing operable condition and status of the detector.

By way of the detector testing switch being a main component of the fully mechanical pneumatic type detector for detecting excessive heat or/and fire, some embodiments of the present invention also feature an apparatus, corresponding to the detector testing switch, for testing operable condition and status of the excessive heat or/and fire detector.

Accordingly, another aspect of some embodiments of the present invention is an apparatus for testing operable condition and status of an excessive heat or/and fire detector, herein, also referred to as the detector testing switch apparatus, and, for brevity, also referred to as the detector testing switch.

The detector testing switch apparatus, in some embodiments, includes the following main structural and functional components, features, and characteristics: a closed housing containing a gaseous fluid (for example, air) and whose top side is configured with a diaphragm sealing element; a releasably pushable button assembly affixed upon and through the diaphragm sealing element; a spring or spring-like element contained inside the closed housing, and whose first end is affixed to the push button assembly and whose second end is affixed to bottom side of the housing; and a fluid duct affixed along and through the bottom side of the housing; whereby pushing the button assembly increases pressure of the gaseous fluid inside the housing, and generates a pressure pulse directed through the fluid duct and into the excessive heat or/and fire detector.

Another aspect of some embodiments of the present invention is a system for detecting excessive heat or/and fire. In some embodiments, the system includes the following main structural and functional components, features, and characteristics: the herein illustratively described fully mechanical pneumatic type detector for detecting excessive heat or/and fire; and a system control device, operatively connected to, and in electrical communication with, the detector.

Additional aspects of some embodiments of the present invention relate to methods or/and procedures for testing an excessive heat or/and fire detector.

According to some embodiments of the present invention, the fully mechanical pneumatic type detector for detecting excessive heat or/and fire is configured for functioning/operating without requiring power, even though the detector is connectable to an externally located electrically powered control device, for example, an external control device, such as a system controller.

Detector for Detecting Excessive Heat or/and Fire, and Operation Thereof

FIG. 1 is a schematic diagram illustrating an exemplary embodiment of the detector (10) for detecting excessive heat or/and fire, shown as part of an exemplary embodiment of an overall system (100) for detecting excessive heat or/and fire, in accordance with some embodiments of the present invention.

In FIG. 1, for illustrative purposes, dotted line 95 is used for aiding in distinguishing the exemplary embodiment of main or/and optional structural and functional components, features, and characteristics, of excessive heat or/and fire detector 10, shown as part of an exemplary embodiment of overall system 100 for detecting excessive heat or/and fire.

According to some embodiments, device 10 for detecting excessive heat or/and fire, for example, excessive heat or/and fire 8 originating from an excessive heat or/and fire source 6, is a fully mechanical pneumatic type detector. In some embodiments, detector 10 for detecting excessive heat or/and fire 8 includes the following main structural and functional components, features, and characteristics: a closed line-type tube 12 containing a gaseous fluid (for example, air) whose pressure is responsive to variations in temperature, for detecting and sensing a potential condition of excessive heat or/and fire 8; a fluid flow restrictor 14 connected to closed line-type tube 12, and in fluid communication with the closed line-type tube fluid and surrounding atmosphere; a pressure switch [PS] 18 connected to closed line-type tube 12 and in fluid communication with the closed line-type tube fluid, and within which a pressure difference is produced in response to a change in pressure of the closed line-type tube fluid; a detector external connector assembly 16 connected to pressure switch [PS] 18 and connectable to an external control device (for example, system controller [SC] 110) and having electrical contacts 20 and 22 configured for contacting each other when the pressure difference in pressure switch [PS] 18 exceeds a threshold value, for actuating the external control device; and a detector testing switch [DTS] 24 connected between closed line-type tube 12 and pressure switch [PS] 18, in fluid communication with the closed line-type tube fluid, and manually operable for generating a pressure pulse in detector 10, for testing operable condition and status of detector 10.

In some embodiments, closed line-type tube 12 is constructed of metallic material(s). In general, closed line-type tube 12 is not limited or restricted in length. For example, in some embodiments, and according to a particular application, closed line-type tube 12 may have a length of about four meters (4 m). In some embodiments, closed line-type tube 12 is configured as a continuous type of closed line-type tube.

In general, the fluid contained by, and within, closed line-type tube 12 is a gaseous type of fluid whose pressure is responsive to variations in temperature, for detecting and sensing a potential condition of excessive heat or/and fire 8. In some embodiments, the contained fluid is a gaseous fluid being a gas mixture, for example, air. Alternatively, in some embodiments, the contained gaseous fluid is an air-like gas mixture, whose main gaseous components are nitrogen and oxygen in a relative proportion similar to that of air. Alternatively, in some embodiments, the contained gaseous fluid is gas mixture of two or more of the following exemplary gases: nitrogen, helium, argon. Alternatively, in some embodiments, the contained gaseous fluid may be a pure gas, for example, nitrogen, or an inert gas, such as helium or argon.

In some embodiments, detector 10 is housed in a detector housing, for example, detector housing 26 [in FIGS. 1, 3-6, shown as dotted-dashed lines between the indicated components of detector 10], configured, for example, as a box, with a space or volume 28, for housing detector 10 and components thereof. Alternatively, detector 64 includes detector housing 26 for housing components of detector 10.

In some embodiments, detector housing 26 (including components of detector 10) is configured on a control panel (not shown), for example, inside the bay or cabin of a vehicle engine or cabinet of a machine (for example, as illustratively described hereinbelow regarding an exemplary application of an overall exemplary system for detecting excessive heat or/and fire, along with reference to FIG. 7).

In some embodiments, detector 10 includes a tube connection adaptor, for example, tube connection adaptor 30, configured along a wall of detector housing 26, for enabling connection and disconnection of closed line-type tube 12 to and from detector 10, via detector housing 26, for example, for installing and replacing closed line-type tube 12.

In some embodiments, detector 10 includes a pressure balancing/equalizing element, for example, pressure balancing/equalizing element 32, in fluid communication with fluid inside detector housing (unoccupied) volume 32 and the surrounding atmosphere (for example, atmospheric air), and configured for balancing/equalizing fluid pressure inside detector housing (unoccupied) volume 32 with the pressure of the surrounding atmosphere (for example, atmospheric pressure). Accordingly, pressure balancing/equalizing element 32 enables detector housing (unoccupied) volume 32 to be in fluid communication with the surrounding atmosphere (i.e., open to the atmosphere), thereby, enabling detector housing (unoccupied) volume 32 to function as a balance of pressure for detector 10. In some embodiments, pressure balancing/equalizing element 32 is configured along, and through, a wall of detector housing 26.

In some embodiments, detector 10 includes a second fluid flow restrictor, for example, fluid flow restrictor 34, configured between detector testing switch [DTS] 24 and pressure switch [PS] 18, and in fluid communication with the closed line-type tube fluid, for restricting fluid flow between detector testing switch [DTS] 24 and pressure switch [PS] 18.

In some embodiments, fluid flow restrictor 14 and fluid flow restrictor 34 are each configured as an orifice or equivalent type structural and functional element, for restricting fluid flow between the indicated components of detector 10. For example, flow resistance of the restrictor 14 is configured and operable for enabling fluid pressure to increase inside of pressure switch [PS] 18. In some embodiments, fluid flow restrictor 14 and fluid flow restrictor 34 are each configured as an orifice or equivalent type structural and functional element, having a diameter in a range of from about 0.001 inch to about 0.002 inch.

In some embodiments, pressure switch [PS] 18 includes a high pressure port 36 and a low pressure port 38.

In some embodiments, detector 10 includes tubing, for example, tubing 40 [in FIGS. 1, 3-6, shown as solid lines between the indicated components of detector 10], configured for enabling fluid communication among the indicated components of detector 10. In some embodiments, tubing 40 is a silicon tubing, or a silicon-type tubing, having a diameter, for example, of ⅛ inch.

In some embodiments, pressure switch [PS] 18 and detector external connector assembly 16 are connectable to each other via electrical wires, for example, electrical wires 42 [in FIGS. 1, 3-6, shown as dashed lines therebetween], for enabling electrical connection/communication therebetween.

In some embodiments, detector 10 includes a fixed temperature thermal switch, for example, fixed temperature thermal switch 44, electrically connected to detector external connector assembly 16, and configured for use when detector 10 operates according to a fixed temperature type detection configuration or mode of operation. According to such embodiments, detector 10 is (structurally and functionally/operationally) configured according to a rate of temperature rise type detection configuration or mode of operation, or/and, according to a fixed temperature type detection configuration or mode of operation.

In some embodiments, fixed temperature thermal switch 44 is configured and operable for being totally (mechanically and electrically) independent of detector 10 functioning or operable according to a rate of temperature rise type detection configuration or mode of operation as illustratively described hereinabove.

In some embodiments, fixed temperature thermal switch 44 and detector external connector assembly 16 are connectable to each other via electrical wires, for example, electrical wires 46 [in FIGS. 1, 3-6, shown as dashed lines therebetween], for enabling electrical connection/communication therebetween.

In some embodiments, detector 10 includes an internally located detector testing mechanism, for example, internally located detector testing mechanism 48, which, as illustratively described hereinbelow (with reference to FIGS. 2 and 4), is configured and operable as part of an exemplary embodiment of testing detector 10. In some embodiments, internally located detector testing mechanism 48 includes an electrical power source, for example, a DC type electrical power source, such as a battery; a visual indicator, for example, a light indicator, such as a light emitting diode (LED) type light indicator; and an audio indicator, for example, a buzzer or similar type of audio indicator. In some embodiments, internally located detector testing mechanism 48 includes a battery, for example, battery 50; an LED, for example, LED 52; and a buzzer, for example, buzzer 54, as illustrated in FIG. 4.

In some embodiments, detector external connector assembly 16 and external control device (for example, system controller [SC] 110) are connectable to each other via electrical wires, for example, electrical wires 112 [in the figures, shown as dashed lines therebetween], and an electrical plug or probe, for example, electrical plug or probe 114, for enabling electrical connection/communication therebetween.

In some embodiments, detector external connector assembly 16 and an externally located detector testing mechanism, for example, externally located detector testing mechanism (116 or 117), are connectable to each other via electrical wires, for example, electrical wires 118 [in the figures, shown as dashed lines therebetween], and an electrical plug or probe, for example, electrical plug or probe 120, for enabling electrical connection/communication therebetween.

Detector Testing Switch [DTS]

As shown in FIG. 1, in detector 10, detector testing switch [DTS] 24 is operatively connected between closed line-type tube 12 and pressure switch [PS] 18, and is in fluid communication, for example, via fluid flow restrictor 34, with the closed line-type tube fluid. As illustratively described in more detail hereinbelow, in some embodiments, detector testing switch [DTS] 24 is manually operable for generating a pressure pulse in detector 10, for testing operable condition and status of detector 10.

Figure 2:
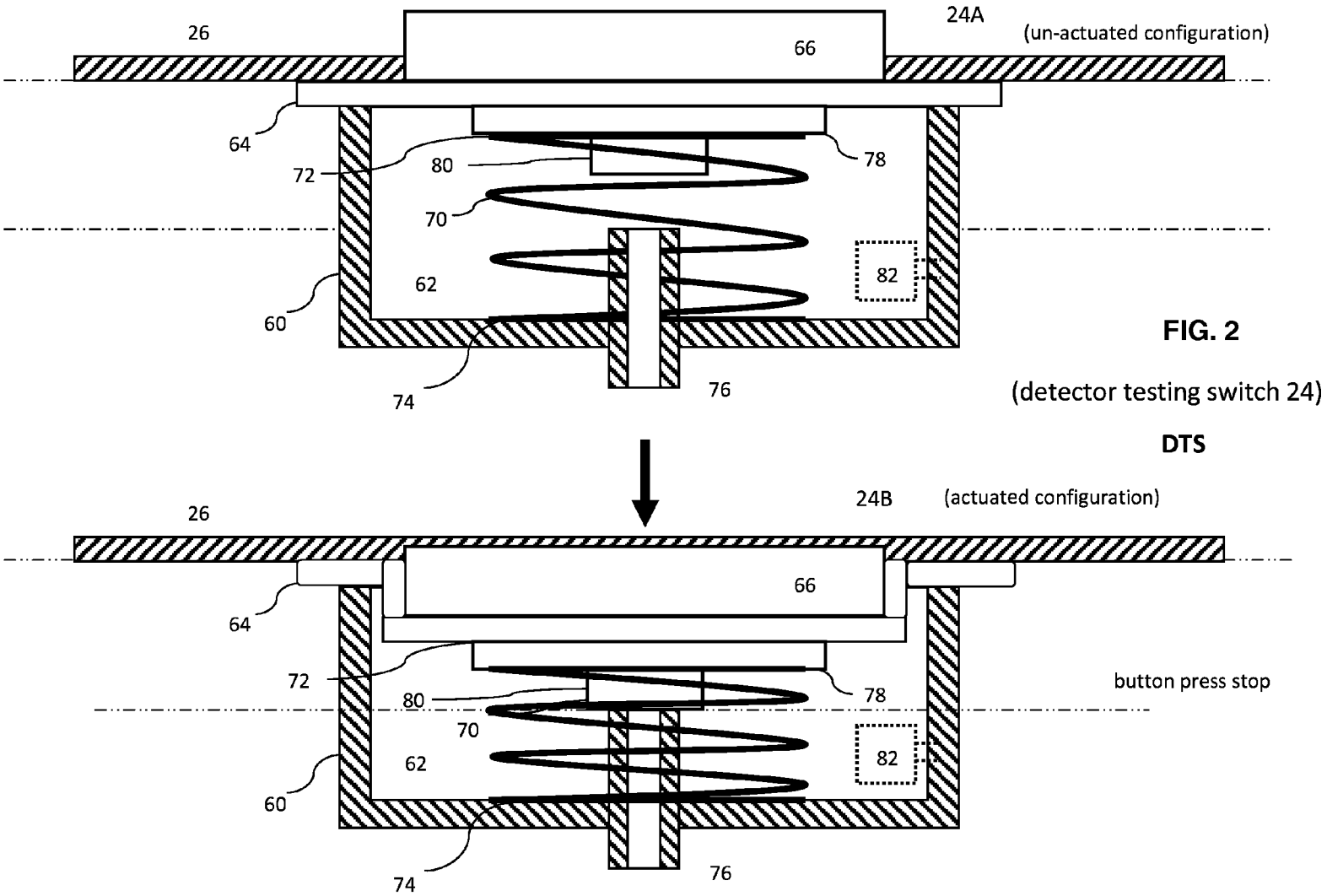
FIG. 2 is a schematic diagram illustrating a detailed cross-sectional view of an exemplary embodiment of the detector testing switch [DTS] (24), included in the detector (10), highlighting an un-actuated configuration (24A) and an actuated configuration (24B), in accordance with some embodiments of the present invention.

FIG. 2 is a schematic diagram illustrating a detailed cross-sectional view of an exemplary embodiment of the detector testing switch [DTS] (24), included in the detector (10), highlighting an un-actuated configuration (24A) and an actuated configuration (24B), in accordance with some embodiments of the present invention.

With reference to FIGS. 1 and 2, by way of detector testing switch [DTS] 24 being a main component of fully mechanical pneumatic type detector 10 for detecting excessive heat or/and fire 8, some embodiments of the present invention also feature an apparatus, corresponding to detector testing switch [DTS] 24, for testing operable condition and status of excessive heat or/and fire detector 10. Accordingly, another aspect of some embodiments of the present invention is an apparatus for testing operable condition and status of excessive heat or/and fire detector 10, herein, also referred to as detector testing switch apparatus [DTS] 24, and, for brevity, also referred to as detector testing switch [DTS] 24.

With particular reference to FIG. 2, detector testing switch apparatus [DTS] 24, in some embodiments, includes the following main structural and functional components, features, and characteristics: a closed housing 60 containing a gaseous fluid 62 (for example, air) and whose top side is configured with a diaphragm sealing element 64; a releasably pushable button assembly 66 affixed upon and through diaphragm sealing element 64; a spring or spring-like element 70 contained inside closed housing 60, and whose first end (in FIG. 2, generally shown by reference number 72) is affixed to push button assembly 66 and whose second end (in FIG. 2, generally shown by reference number 74) is affixed to bottom side of closed housing 60; and a fluid duct 76 affixed along and through the bottom side of closed housing 60; whereby pushing button assembly 66 increases pressure of gaseous fluid 62 inside closed housing 60, and generates a pressure pulse directed through fluid duct 76 and into excessive heat or/and fire detector 10.

In some embodiments, spring or spring-like element 70 is configured for being flexible, and contractable/expandable inside closed housing 60, for example, corresponding to detector testing switch [DTS] 24 having an 'un-actuated' configuration 24A and an 'actuated' configuration 24B.

In some embodiments, diaphragm sealing element 64 is attached along a portion of the inner wall of detector housing 26.

In some embodiments, detector testing switch [DTS] 24 includes an adaptor, for example, adaptor 78, for connecting releasably pushable button assembly 66 to diaphragm sealing element 64.

In some embodiments, fluid duct 76 is a duct through which gaseous fluid 62 (for example, air) is directed and passes from inside of closed housing 60 and through detector fluid flow restrictor 34, via tubing 40.

In some embodiments, detector testing switch [DTS] 24 includes a sealing nut, for example, sealing nut 80, configured for providing sealing between adaptor 78 and fluid duct 76. For example, such sealing takes places when detector testing switch [DTS] 24 is activated, for example, via depressing (pushing, pressing) of releasably pushable button assembly 66, and changes from an 'un-actuated' configuration 24A to an 'actuated' configuration 24B.

In some embodiments, detector testing switch [DTS] 24 includes a micro-heater, for example, micro-heater 82, connectable to, and actuatable by, an external control device (for example, system controller [SC] 110), for example, via electrical wires, for example, electrical wires 84 (shown in FIG. 5).

Additional Aspects of the Detector Testing Switch [DTS]

In some embodiments, additional aspects of detector testing switch [DTS] 24 are associated with various physical properties, characteristics, features, or/and size dimensions, thereof.

For example, in some embodiments, detector testing switch [DTS] 24 is configured for being operable in a temperature range of from about minus forty degrees Celsius (−40° C.) to about plus one-hundred and twenty-five degrees Celsius (+125° C.).

For example, in some embodiments, detector testing switch [DTS] 24 is configured whereby diaphragm sealing element 64 spans a distance (diameter) of about thirty millimeters (30 mm).

For example, in some embodiments, detector testing switch [DTS] 24 is configured whereby bottom side of closed housing 60 spans a distance (diameter) of about twenty millimeters (20 mm).

For example, in some embodiments, detector testing switch [DTS] 24 is configured whereby bottom side of closed housing 60 to top side of releasably pushable button assembly 66 spans a distance (height) of about twenty millimeters (20 mm).

For example, in some embodiments, detector testing switch [DTS] 24 includes closed housing 60 being configured (constructed) from an engineered type plastic, for example, polycarbonate.

For example, in some embodiments, detector testing switch [DTS] 24 is configured whereby spring or spring-like element 70 is configured and operable for being flexible, and contractable/expandable inside closed housing 60. In some embodiments, spring or spring-like element 70 is configured (constructed) from a flexible (contractable/expandable) metallic material, for example, stainless steel.

For example, in some embodiments, detector testing switch [DTS] 24 is configured whereby spring or spring-like element 70 is configured and operable such that detector testing switch [DTS] 24 is capable of generating a highly accurate, low magnitude pressure pulse within a pre-determined range characterized by a pre-determined (not less than) lower limit pressure pulse and a pre-determined (not more than) upper limit pressure pulse, for example, when fluid duct 76 of detector testing switch [DTS] 24 is connected to fluid flow restrictor 34 via tubing 40 having a length in a range of from about five centimeters (5 cm) to about ten centimeters (10 cm).

Some Characteristic Differences Between the Detector Testing Switch [DTS] of the Detector and Ordinary Air Type Switches, and Limitations of Ordinary Air Type Switches For example, under extreme conditions of temperature, ordinary air type switches are limited due to their structure or/and materials of construction. For example, ordinary air type switches are limited due to their being configured (constructed) and operable for normal indoor use and applications. For example, ordinary air type switches are typically configured for being operable in a narrower temperature range of from about plus ten degrees Celsius (+10° C.) to about plus fifty degrees Celsius (+50° C.).

For example, ordinary air type switches are typically configured with size dimensions being significantly larger than size dimensions of detector testing switch [DTS] 24. For example, ordinary air type switches are typically configured whereby a type of diaphragm sealing element spans a distance (diameter) in a range of from about forty millimeters (40 mm) to about sixty millimeters (60 mm); whereby the housing thereof spans a distance (diameter) of about thirty-five millimeters (35 mm); and whereby the bottom side of the housing to the top side of a type of pushable button assembly spans a distance (height) in a range of from about forty millimeters (40 mm) to about sixty millimeters (60 mm).

For example, ordinary air type switches are typically configured (constructed) from a standard type of plastic, for example, ABS (acrylonitrile-butadiene-styrene). For example, ordinary air type switches are typically configured and operable with a rubber bell or bellows type of flexible, and contractable/expandable element inside the switch housing.

For example, ordinary air type switches are typically configured and operable without being controllable, for generating a pressure pulse which is normally inaccurate and too high for the type of operation of herein described detector testing switch [DTS] 24 as part of detector 10 of some embodiments of the present invention. For example, ordinary air type switches are typically configured and operable whereby the rubber bell or bellows type of pressure generating element generates a relatively inaccurate, high magnitude pressure pulse absent of a pre-determined (not more than) upper limit pressure pulse.

For example, ordinary air type switches are typically connected to tubing having a significantly larger length in a range of from about one meter (1 m) to about three meters (3 m). For example, ordinary air type switches typically cost significantly more (for example, about 3 times more) than the herein described detector testing switch [DTS] 24.

Types of Detection Configuration or Mode of Operation of the Excessive Heat or/and Fire Detector According to some embodiments, excessive heat or/and fire detector 10 is (structurally and functionally/operationally) configured according to a rate of temperature rise type detection configuration or mode of operation, or/and, according to a fixed temperature type detection configuration or mode of operation. In some embodiments, for a particular application, and according to particular user requirements, detector 10 functions and operates according to only one type of detection configuration or mode of operation, namely, either according to a rate of temperature rise type detection configuration or mode of operation, or, according to a fixed temperature type detection configuration or mode of operation.

Rate of Temperature Rise Type Detection Configuration or Mode of Operation

In some embodiments of the present invention, an excessive heat or/and fire source 6 generates excessive heat or/and fire 8 in the vicinity of detector 10. Excessive heat or/and fire 8 causes a temperature rise on and inside closed line-type tube (excessive heat or/and fire sensing element) 12. Change of temperature results in a rise of air pressure inside closed line-type tube 12. The air pressure rise is directed to pressure switch [PS] 18 high pressure port 36. The air pressure is also directed, via fluid flow restrictor 14, to pressure switch [PS] 18 low pressure port 38. This process causes a pressure difference to occur between high and low pressure ports 36 and 38, respectively, of pressure switch [PS] 18.

In some embodiments, pressure switch [PS] 18 has a predetermined pressure difference (differential) threshold limit, for example, in a range of from about 1 millibar [mBar]=(1 cm WC [water column]) to about 10 millibars [mBar]=(10 cm WC [water column]). In some embodiments, the pressure difference threshold limit is determined and set according to desired performance and calibration of detector 10, which, in turn, are in accordance with actual application of detector 10 in an overall detection system, for example, detection system 100.

In some embodiments, when the pressure difference that accumulates within pressure switch [PS] 18 exceeds the pressure difference threshold limit, then electrical contacts 20 and 22 contact each other and form an electrical connection which is recognized by external control device (for example, system controller [SC] 110) as a condition or event of excessive heat or/and fire. In some embodiments, in response thereto, there is activation of a warning or alarming device, for example, warning or alarming device 122, included in some embodiments of excessive heat or/and fire detecting system 100. Warning or alarming device 122 includes, for example, a visual indicator, for example, a light indicator, such as a light emitting diode (LED) type light indicator, or, an audio indicator, for example, a buzzer or similar type of audio indicator, or, alternatively, a combination of both types of indicators, which functions as a warning or alarming of a condition of excessive heat or/and fire.

In some embodiments, detector housing (unoccupied) volume 32, via pressure balancing/equalizing element 32, is in fluid communication with the surrounding atmosphere (i.e., open to the atmosphere), thereby, enabling detector housing (unoccupied) volume 32 to function as a balance of pressure for detector 10.

As part of developing, and reducing to practice, some embodiments of the present invention, experimentation was performed in order to measure and determine one or more optimal functional (operational) combinations of the following components or/and parameters thereof: volume of closed line-type tubing 1, detector housing (unoccupied) volume 32, size of fluid flow restrictor 14, and pressure switch [PS] (7), of detector 10. For example, experiments were performed and a relationship was determined between size of fluid flow restrictor 14 and response time to a condition of excessive heat or/and fire.

As described above, during operation of detector 10, when the pressure difference that accumulates within pressure switch [PS] 18 exceeds the pressure difference threshold limit, then electrical contacts 20 and 22 contact each other and form an electrical connection which is recognized by external control device (system controller [SC] 110) as a condition or event of excessive heat or/and fire. Accordingly, as long as the pressure difference within pressure switch [PS] 18 is equal to or less than (i.e., equals or remains below) the pressure difference threshold limit, then electrical contacts 20 and 22 are not in contact each other and do not form an electrical connection, and therefore, such is not recognizable by external control device (system controller [SC] 110) as a condition or event of excessive heat or/and fire.

In some embodiments, pressure switch [PS] 18 is designed and configured to operate (function) with a 'dead gap', or non-actuated interval or range, of pressure differences caused by 'normal' (i.e., non-excessive heat or/and fire) thermal changes (for example, minor changes in room temperature) that take place on and inside closed line-type tube (excessive heat or/and fire sensing element) 1. Accordingly, during 'normal' thermal changes, pressure switch [PS] 18 operates within this 'dead gap', or non-actuated interval or range, of pressure differences, whereby the pressure difference within pressure switch [PS] 18 is equals or remains below the pressure difference threshold limit. Under such operating conditions, electrical contacts 20 and 22 do not contact each other and do not form an electrical connection, and therefore, such is not recognizable by external control device (system controller [SC] 110) as a condition or event of excessive heat or/and fire.

In some embodiments, pressure switch [PS] 18 is designed to ignore shock and vibration such as those which are associated with vehicular transportation type applications for detecting excessive heat or/and fire in a vehicle, for example, an automobile, bus, or personnel transport vehicle.

Fixed Temperature Type Detection Configuration or Mode of Operation

In some embodiments, detector 10 includes fixed temperature thermal switch 44, electrically connected, via electrical wires 46, to detector external connector assembly 16, and configured for use when detector 10 operates according to a fixed temperature type detection configuration or mode of operation.

In some embodiments, fixed temperature thermal switch 44 is configured on the same panel used for holding detector 10 and components thereof, for example, inside the bay or cabin of a vehicle engine or cabinet of a machine motor, and is directly exposed to heat generated inside the bay or cabinet compartment.

In some embodiments, fixed temperature thermal switch 44 has a pre-determined set point (threshold) temperature, for example, normally above ninety degrees Celsius (90° C.), such that when the heat (i.e., excessive heat) causes the temperature to increase to an abnormally high temperature, electrical contacts in fixed temperature thermal switch 44 contact each other and close. In response to contact and closure of the electrical contacts, an excessive heat or/and fire warning or alarm device is activated. In some embodiments, fixed temperature thermal switch 44 is configured to hold/maintain the warning device in an activated configuration until the temperature decreases to below the pre-determined set point (threshold) temperature, for example, normally to a temperature ten degrees Celsius (10° C.) below the pre-determined set point (threshold) temperature.

In some embodiments, fixed temperature thermal switch 44 is configured and operable for being totally (mechanically and electrically) independent of detector 10 functioning or operable according to a rate of temperature rise type detection configuration or mode of operation.

Calibrating (Adjusting) the Excessive Heat or/and Fire Detector

In some embodiments, excessive heat or/and fire detector 10 may be calibrated (or adjusted) according to a rate of temperature rise type detection configuration or mode of operation, or, according to a fixed temperature type detection configuration or mode of operation. In general, for each type detection configuration or mode of operation, the detector calibration (adjustment) procedure is based on determining, and accordingly setting detector 10 components to, the level of heat that is recognizable by external control device (system controller [SC] 110) as a condition or event of excessive heat or/and fire.

Rate of Temperature Rise Calibration (or Adjustment) of the Detector Using a Flame Torch In some embodiments, excessive heat or/and fire detector 10 may be calibrated (or adjusted) according to a rate of temperature rise type detection configuration or mode of operation, using a flame torch.

Such a detector calibration (or adjustment) procedure may be performed in a manner similar to calibrating (or adjusting) a linear line-type of excessive heat or/and fire detector. In general, this type of calibration (adjustment) procedure is based on determining, and setting detector 10 accordingly to, the level of heat that is recognizable by external control device (system controller [SC] 110) as a condition or event of excessive heat or/and fire.

An exemplary 'default' calibration (and detector sensitivity) setting corresponds to closed line-type tube 12 directly exposed to a flame length of six (6) inch (150 mm) generated from a flame torch resulting in external control device (system controller [SC] 110) recognizing this as a condition or event of excessive heat or/and fire within about five (5) seconds, at which time, in response thereto, there is activation of warning or alarming device 122.

Rate of Temperature Rise Calibration (or Adjustment) of the Detector Using a Computerized Temperature Controlled Test Chamber In some embodiments, excessive heat or/and fire detector 10 may be calibrated (or adjusted) according to a rate of temperature rise type detection configuration or mode of operation, using a computerized temperature controlled test chamber.

Such a detector calibration (or adjustment) procedure may be performed according to a rate of temperature rise (temperature rise step or interval size), for example, in a range of from about ten degrees Celsius per minute (10° C./minute) to about one-hundred degrees Celsius per minute (100° C./minute), or higher, depending upon the particular required pre-determined set point (threshold level) temperature.

Fixed Temperature Calibration (or Adjustment) of the Detector

In some embodiments, excessive heat or/and fire detector 10 may be calibrated (or adjusted) according to a fixed temperature type detection configuration or mode of operation.

Such a detector calibration (or adjustment) procedure is performed by configuring fixed temperature thermal switch 44 with a pre-determined set point (threshold) temperature above which there is activation of detector external connector assembly 16, for example, whereby electrical contacts 20 and 22 contact each other and form an electrical connection. This, in turn, is recognized by external control device (system controller [SC] 110) as a condition or event of excessive heat or/and fire. In some embodiments, in response thereto, external control device (system controller [SC] 110) activates a warning or alarming device, for example, warning or alarming device 122.

In some embodiments, an exemplary set point (threshold) temperature is selected from a single temperature in the range of from about eighty degrees Celsius (80° C.) to about one-hundred and twenty degrees Celsius (120° C.). In some embodiments, an exemplary set point (threshold) temperature is selected from the group consisting of one-hundred degrees Celsius (100° C.), eighty degrees Celsius (80° C.), and one-hundred and twenty degrees Celsius (120° C.).

For example, a set point (threshold) temperature may be selected at a value corresponding to fixed temperature thermal switch 44 sensing that temperature inside the bay or cabin of a vehicle engine or cabinet of a machine motor has reached 100° C., or 80° C., or 120° C.

Testing of the Excessive Heat or/and Fire Detector

In general, in some embodiments of the present invention, testing of detector 10 is performed using detector testing switch [DTS] 24 for enabling simple and immediate testing operable condition and status of detector 10, including, for example, testing intactness or integrity (such as non-leakage) and status (operability) of components of detector 10, in a mostly or fully mechanical manner simulating an actual condition of excessive heat or/and fire in the vicinity of detector 10.

In general, in some embodiments of the present invention, testing of detector 10 may involve additional mechanical means or/and electrical means configured and operable internal or/and external to detector 10. For example, in some embodiments, as shown in FIGS. 2 and 4, an internally located detector testing mechanism 48 [50, 52, 54], includes an electrical power source, for example, a DC type electrical power source, such as battery 50, for testing detector 10. According to such embodiments, the electrical power source is used only for testing detector 10, and does not affect the (detection) functionality or operation of detector 10 for detecting excessive heat or/and fire.

Testing Via Using an Externally Located Detector Testing Mechanism (FIGS. 1, 2, and 3)

Reference is made to FIGS. 1 and 2, and additionally, to FIG. 3 of a schematic diagram illustrating an exemplary embodiment of testing detector 10 using an externally located detector testing mechanism (116, 117), as part of exemplary overall system 100 for detecting excessive heat or/and fire, according to some embodiments of the present invention.

In some embodiments, externally located detector testing mechanism 116 (as shown in FIG. 1) is, for example, an externally located volt-ohm multi-meter (VOM) type of electrical circuit measuring device, for example, volt-ohm multi-meter (VOM) device 117 (as shown in FIG. 3). Detector external connector assembly 16 and externally located detector testing mechanism, for example, volt-ohm multi-meter (VOM) device 117, are connectable to each other via electrical wires 118 and electrical plug or probe 120, for enabling electrical connection/communication therebetween. In some embodiments, externally located detector testing mechanism (116, 117) is electrically connectable, via electrical plug or probe 120, to electrical contacts 20 and 22 of detector external connector assembly 16.

In some embodiments, for performing this type of detector testing, electrical plug or probe 114 of the external control device (system controller [SC] 110) is disconnected from electrical contacts 20 and 22 of detector external connector assembly 16. Then, externally located detector testing measuring device 116 (volt-ohm multi-meter (VOM) device 117) is connected to electrical contacts 20 and 22 of detector external connector assembly 16.

In some embodiments, with reference to FIG. 2 (24A and 24B) releasably pushable button assembly 66 is pushed against diaphragm sealing element 64 and spring or spring-like element 70 until stopping (via reaching a button press stop position), and held in that position for a period of time in a range of from about two seconds to about three seconds. Thereafter, volume of gaseous fluid 62 contracts, thereby, causing a pressure increase inside volume of gaseous fluid 62. The increased air pressure is directed through fluid flow restrictor 34 and into closed line-type tube 12, thereby causing an increase in fluid pressure inside of closed line-type tube 12.

In the case that closed line-type tube 12 is tightly closed and properly sealed (i.e., not leaking), and inside fluid connections and components are intact, then, a favorable (pass test) result occurs when externally located detector testing measuring device 116 (volt-ohm multi-meter (VOM) device 117) indicates (e.g., displays) a change from an 'open circuit' to a 'closed circuit', thereby passing the test, and confirming a proper operable condition and status of detector 10.

Alternatively, in the case that closed line-type tube 12, or/and other components of detector 10, is/are not tightly closed or/and properly sealed (i.e., leaking), or/and one or more components of detector 10 is malfunctioning, then, an unfavorable (fail test) result occurs when externally located detector testing measuring device 116 (volt-ohm multi-meter (VOM) device 117) indicates no change from an 'open circuit' to a 'closed circuit', thereby, failing the test, and confirming an improper operable condition and status of detector 10.

Following the testing procedure, externally located detector testing measuring device 116 (volt-ohm multi-meter (VOM) device 117), via electrical plug or probe 120, is disconnected from electrical contacts 20 and 22 of detector external connector assembly 16, and the external control device (system controller [SC] 110), via electrical plug or probe 114, is reconnected to, electrical contacts 20 and 22 of detector external connector assembly 16.

Testing Via Using an Internally Located Detector Testing Mechanism (FIGS. 1, 2, and 4)

Reference is made to FIGS. 1 and 2, and additionally, to FIG. 4 of a schematic diagram illustrating an exemplary embodiment of testing detector 10 using an internally located detector testing mechanism 48 [23, 24, 25], as part of exemplary overall system 100 for detecting excessive heat or/and fire, according to some embodiments of the present invention.

In some embodiments, internally located detector testing mechanism 48 includes an electrical power source, for example, a DC type electrical power source, such as a battery; a visual indicator, for example, a light indicator, such as a light emitting diode (LED) type light indicator; and an audio indicator, for example, a buzzer or similar type of audio indicator. In some embodiments, internally located detector testing mechanism 48 includes a battery, for example, battery 50; an LED, for example, LED 52; and a buzzer, for example, buzzer 54, as illustrated in FIG. 4. According to such embodiments, these components, namely, battery 50, LED 52, and buzzer 54, are connectable, via electrical wires, for example, electrical wires 56 [in FIG. 4, shown as dashed lines therebetween], for configuring internally located detector testing mechanism 48 as a complete electrical circuit.

In some embodiments, for performing this type of detector testing, electrical plug 11 of the external control device (system controller [SC] 110) is disconnected from electrical contacts 20 and 22 of detector external connector assembly 16.

In some embodiments, releasably pushable button assembly 66 is pushed against diaphragm sealing element 64 and spring or spring-like element 70 until stopping (via reaching a button press stop position), and held in that position for a period of time in a range of from about two seconds to about three seconds.

Thereafter, volume of gaseous fluid 62 contracts, thereby, causing a pressure increase inside volume of gaseous fluid 62. The increased air pressure is directed through fluid flow restrictor 34 and into closed line-type tube 12, thereby causing an increase in fluid pressure inside of closed line-type tube 12.

In some embodiments, in the case that closed line-type tube 12 is tightly closed and properly sealed (i.e., not leaking), and inside fluid connections and components are intact, then, a favorable (pass test) result is indicated by activation of LED 52 (lighting up) or/and buzzer 54 (sounding), being powered by internal battery 50.

Alternatively, in the case that closed line-type tube 12, or/and other components of detector 10, is/are not tightly closed or/and properly sealed (i.e., leaking), or/and one or more components of detector 10 is malfunctioning, then, an unfavorable (fail test) result is indicated by inactivation of LED 52 (not lighting up) or/and buzzer 54 (not sounding).

Following the test procedure, electrical plug or probe 114 of external control device (system controller [SC] 110) is reconnected to, electrical contacts 20 and 22 of detector external connector assembly 16.

Testing Via Using an Internally Located Micro-Heater and Externally Located Power Source (FIGS. 1, 2 (24B), and 5)

Reference is made to FIGS. 1 and 2 (24B), and additionally, to FIG. 5 of a schematic diagram illustrating an exemplary embodiment of testing detector 10 using an internally located micro-heater 82 of detector 10 and an externally located power source (for example, via external control device (system controller [SC] 110), as part of exemplary overall system 100 for detecting excessive heat or/and fire, according to some embodiments of the present invention.

In some embodiments, for performing this type of detector testing, as shown in FIG. 2 (24B), detector testing switch apparatus [DTS] 24 includes therein a micro-heater, for example, micro-heater 82, connectable to, and actuatable by, external control device (system controller [SC] 110), for example, via electrical wires 84 (shown in FIG. 5).

In some embodiments, this testing is a remotely performed (non-manual, automatic) type of electrical testing, without involving use of pushable button assembly 66. Accordingly, in such embodiments, only closed housing 60 containing gaseous fluid 62 is used for this type of detector testing.

In some embodiments, micro-heater 82 is electrically connected to external control device (system controller [SC] 110), for example, via detector external connector assembly 16 and electrical plug or probe 114. Then, external control device (system controller [SC] 110) runs a pre-programmed test, for example, including the following steps/procedures: (i) 'temporarily' disabling system 100 of having the capability of automatically activating fire extinguishing equipment; (ii) activating micro-heater 82 for a short period of time, for example, on the order of several seconds, for example, three (3) seconds; (iii) checking the 'closed'/'opened' operational status of electrical contacts 20 and 22 of detector external connector assembly 16; and (iv) re-enabling system 100 for again having the capability of automatically activating fire extinguishing equipment.

In the case that the detector 10 is properly functioning, then, a favorable (pass test) result occurs when external control device (system controller [SC] 110) indicates a proper operational status of electrical contacts 20 and 22.

Manual Operation of the Detector, Via Detector Testing Switch [DTS], for Manually Activating an Exemplary Overall System for Detecting Excessive Heat or/and Fire Reference is made to FIGS. 1 and 2, and additionally, to FIG. 6 of a schematic diagram illustrating an exemplary embodiment of manual operation of excessive heat or/and fire detector 10, via detector testing switch [DTS] 24, for manually activating exemplary overall system 100 for detecting excessive heat or/and fire, according to some embodiments of the present invention.

In some embodiments, detector 10 is directly electrically connected, via detector external connector assembly 16, electrical plug or probe 114, and electrical wires 112, to external control device (system controller [SC] 110). In some embodiments, fire extinguishing equipment, for example, automatic electrically activated fire extinguishing equipment 160, is also operatively connected to external control device (system controller [SC] 110).

In some embodiments, pushing button assembly 66 of detector testing switch [DTS] 24 activates fire extinguishing equipment 160. According to such embodiments, use of detector testing switch [DTS] 24 eliminates need of adding an electrical switch for this purpose. This is a particularly advantageous feature for an exemplary embodiment including detector housing 26 and detector testing switch [DTS] 24 located within 'manual' reach by a user or operator of excessive heat or/and fire detection system 100. For example, where closed line-type tube 12 is configured within or along the bay or cabin of a vehicle engine or cabinet of a machine motor, thereby being exposed to heat generated therefrom, but detector housing 26 and detector testing switch [DTS] 24 are installed outside of the bay or cabin of the vehicle engine or cabinet of the machine motor.

System for Detecting Excessive Heat or/and Fire

Another aspect of some embodiments of the present invention is a system for detecting excessive heat or/and fire. In some embodiments, the system includes the following main structural and functional components, features, and characteristics: the hereinabove illustratively described fully mechanical pneumatic type detector for detecting excessive heat or/and fire; and a system control device, operatively connected to, and in electrical communication with, the detector.

With reference to FIGS. 1, and 3-6, in some embodiments, the system corresponds to system 100, the detector included in the system corresponds to hereinabove illustratively described detector 10, and the system control device corresponds to hereinabove illustratively described external control device (system controller [SC] 110) operatively connected to, and in electrical communication with, detector 10.

As illustratively described hereinabove, according to some embodiments of the present invention, excessive heat or/and fire detector 10 is (structurally and functionally/operationally) configured according to a rate of temperature rise type detection configuration or mode of operation, or/and, according to a fixed temperature type detection configuration or mode of operation. According to such embodiments, similarly, system 100 is (structurally and functionally/operationally) configured according to a rate of temperature rise type detection configuration or mode of operation, or/and, according to a fixed temperature type detection configuration or mode of operation. Accordingly, detector 10, and system 100 including detector 10, may be configured according to either one type or both types of detection configuration or mode of operation.

Exemplary Application of the System for Detecting Excessive Heat or/and Fire

Reference is made to FIG. 7 of a schematic diagram illustrating an exemplary embodiment of installation of detector 10 for detecting excessive heat or/and fire, as part of an exemplary embodiment of exemplary system 150 for detecting excessive heat or/and fire of a vehicle engine or of a machine, in accordance with some embodiments of the present invention.

In exemplary system 150, detector 10 and external control device (system controller [SC] 110) are operatively connectable to each other, for example, via electrical wires 152, for enabling electrical connection/communication therebetween.

In exemplary system 150, an exemplary vehicle engine or machine [such as a machine motor or components thereof] (in FIG. 7, generally shown by area enclosed by reference number 154) is contained within a bay or cabin space 156 coverable by a cover 158 (shown in an opened position).

In some embodiments, detector housing 26 (including components of detector 10) is configured on a control panel, for example, located inside bay or cabin space 156 of vehicle engine or machine 154. In some embodiments, closed line-type tube 12 (of detector 10) containing gaseous fluid (for example, air) is installed in the upper side of bay or cabin 156 over the body of vehicle engine or machine 154, and detector 10 is operatively connected to external control device (system controller [SC] 110).

In some embodiments, system 150 includes fire extinguishing equipment, for example, fire extinguishing equipment 160, for example, located in a designated space or cavity 161.

In some embodiments, fire extinguishing equipment 160 is configured with an electrical valve, for example, electrical valve 162, which is electrically connected, via electrical wires 164, to external control device (system controller [SC] 110). In some embodiments, a dispensing/dispersing manifold including piping equipment, for example, dispensing/dispersing manifold including flexible piping or/and metal pipes 166, is operatively connected to fire extinguishing equipment 160.

In some embodiments, nozzles 168 for dispensing and dispersing a fire extinguishing material or agent, for example, fire extinguishing material or agent 170, are operatively connected onto the ends of flexible piping or/and metal pipes 166.

According to such an embodiment, when vehicle engine or machine 154 generates excessive heat or/and fire, the pressure difference accumulating within pressure switch [PS] 18 of detector 10 exceeds the pressure difference threshold limit. This causes electrical contacts 20 and 22 to contact each other and form an electrical connection which, via electrical wires 152, is recognized by external control device (system controller [SC] 110) as a condition or event of excessive heat or/and fire. In response thereto, external control device (system controller [SC] 110), via fire extinguisher electrical valve 162, activates fire extinguishing equipment 160, whereby nozzles 168 dispense and disperse fire extinguishing material or agent 170 into bay or cabin 156 of vehicle engine or machine 154, thereby, dissipating the excessive heat or/and extinguishing the fire.

It is to be understood that the present invention is not limited in its application to the details of type, composition, construction, arrangement, order, and number, of the system units, system sub-units, devices, assemblies, sub-assemblies, mechanisms, structures, components, elements, and configurations, and, peripheral equipment, utilities, accessories, and materials, of exemplary embodiments of the invention, or to the details of the order or sequence, number, of steps or procedures, and sub-steps or sub-procedures, of exemplary embodiments of the invention, set forth in the following illustrative description, and accompanying drawings, unless otherwise specifically stated herein. The present invention can be practiced or implemented according to various other alternative exemplary embodiments and in various other alternative ways.

Phraseology, terminology, and, notation, employed herein throughout the present disclosure are for the purpose of exemplary and illustrative description and should not be regarded as limiting. Moreover, all technical and scientific words, terms, or/and phrases, introduced, defined, described, or/and exemplified, in the above Field and Background sections, are equally or similarly applicable in the illustrative description of the exemplary embodiments, examples, and appended claims, of some embodiments of the present invention.

Each of the following terms written in singular grammatical form: 'a', 'an', and 'the', as used herein, means 'at least one', or 'one or more'. Use of the phrase 'one or more' herein does not alter this intended meaning of 'a', 'an', or 'the'. Accordingly, the terms 'a', 'an', and 'the', as used herein, may also refer to, and encompass, a plurality of the stated entity or object, unless otherwise specifically defined or stated herein, or, unless the context clearly dictates otherwise. For example, the phrases: 'a unit', 'a device', 'an assembly', 'a mechanism', 'a component', 'an element', and 'a step or procedure', as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: 'includes', 'including', 'has', 'having', 'comprises', and 'comprising', and, their linguistic/grammatical variants, derivatives, or/and conjugates, as used herein, means 'including, but not limited to', and is to be taken as specifying the stated component(s), feature(s), characteristic(s), parameter(s), integer(s), or step(s), and does not preclude addition of one or more additional component(s), feature(s), characteristic(s), parameter(s), integer(s), step(s), or groups thereof. Each of these terms is considered equivalent in meaning to the phrase 'consisting essentially of'.

The phrase 'consisting essentially of', as used herein, means that the stated entity or item (system, system unit, system sub-unit, device, assembly, sub-assembly, mechanism, structure, component, element, composition or formulation, or, peripheral equipment, utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional 'feature or characteristic' being a system unit, system sub-unit, device, assembly, sub-assembly, mechanism, structure, component, or element, or, peripheral equipment, utility, accessory, or material, step or procedure, sub-step or sub-procedure), but only if each such additional 'feature or characteristic' does not materially alter the basic novel and inventive characteristics or special technical features, of each claimed entity or item (system, device, method or process, or/and composition).

Each of the phrases 'consisting of' and 'consists of', as used herein, means 'including and limited to'.

The term 'method', as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

The phrase 'operatively connected', as used herein, equivalently refers to the corresponding synonymous phrases 'operatively joined', and 'operatively attached', where the operative connection, operative joint, or operative attachment, is according to a physical, or/and electrical, or/and electronic, or/and mechanical, or/and electro-mechanical, manner or nature, involving various types and kinds of hardware or/and software equipment and components. Additionally, the terms 'connectable', 'connected', and 'connecting', are generally used herein, and also may refer to the corresponding synonymous terms 'joinable', 'joined', and 'joining', as well as 'attachable', 'attached', and 'attaching'.

The term 'about', as used herein, refers to ±10% of the stated numerical value.

The phrase 'room temperature', as used herein, refers to a temperature in a range of between about 20° C. and about 25° C.

Throughout the illustrative description of some exemplary embodiments, the examples, and the appended claims, of the present invention, a numerical value of a parameter, feature, object, or dimension, may be stated or described in terms of a numerical range format. It is to be fully understood that the stated numerical range format is provided for illustrating implementation of some exemplary embodiments of the present invention, and is not to be understood or construed as inflexibly limiting the scope of the exemplary embodiments of the present invention.

Accordingly, a stated or described numerical range also refers to, and encompasses, all possible sub-ranges and individual numerical values (where a numerical value may be expressed as a whole, integral, or fractional number) within that stated or described numerical range. For example, a stated or described numerical range 'from 1 to 6' also refers to, and encompasses, all possible sub-ranges, such as 'from 1 to 3', 'from 1 to 4', 'from 1 to 5', 'from 2 to 4', 'from 2 to 6', 'from 3 to 6', etc., and individual numerical values, such as '1', '1.3', '2', '2.8', '3', '3.5', '4', '4.6', '5', '5.2', and '6', within the stated or described numerical range of 'from 1 to 6'. This applies regardless of the numerical breadth, extent, or size, of the stated or described numerical range.

Moreover, for stating or describing a numerical range, the phrase 'in a range of between about a first numerical value and about a second numerical value', is considered equivalent to, and meaning the same as, the phrase 'in a range of from about a first numerical value to about a second numerical value', and, thus, the two equivalently meaning phrases may be used interchangeably. For example, for stating or describing the numerical range of room temperature, the phrase 'room temperature refers to a temperature in a range of between about 20° C. and about 25° C.', is considered equivalent to, and meaning the same as, the phrase 'room temperature refers to a temperature in a range of from about 20° C. to about 25° C.'.

It is to be fully understood that certain aspects, characteristics, and features, of the present invention, which are illustratively described and presented in the context or format of a plurality of separate embodiments, may also be illustratively described and presented in any suitable combination or sub-combination in the context or format of a single embodiment. Conversely, various aspects, characteristics, and features, of the present invention, which are illustratively described and presented in combination or sub-combination in the context or format of a single embodiment, may also be illustratively described and presented in the context or format of a plurality of separate embodiments.

Although the present invention has been illustratively described and presented by way of specific exemplary embodiments thereof, and examples thereof, it is evident that many alternatives, modifications, and variations, thereof, will be apparent to those skilled in the art. Accordingly, it is intended that all such alternatives, modifications, and variations, fall within, and are encompassed by, the scope of the appended claims.

All patents, patent applications, and publications, cited or referred to in this specification are herein incorporated in their entirety by reference into the specification, to the same extent as if each individual patent, patent application, or publication, was specifically and individually indicated to be incorporated herein by reference. In addition, citation or identification of any reference in this specification shall not be construed or understood as an admission that such reference represents or corresponds to prior art of the present invention. To the extent that section headings are used, they should not be construed as necessarily limiting.

What is claimed is:

1. A device for detecting excessive heat or/and fire, the device comprising:

a closed line-type tube containing a gaseous fluid whose pressure is responsive to variations in temperature, for detecting and sensing a potential condition of excessive heat or/and fire;

a fluid flow restrictor connected to said closed line-type tube, and in fluid communication with said closed line-type tube fluid and surrounding atmosphere;

a pressure switch connected to said closed line-type tube and in fluid communication with said closed line-type tube fluid, and within which a pressure difference is produced in response to a change in pressure of said closed line-type tube fluid;

a detector external connector assembly connected to said pressure switch and connectable to an external control device, and having electrical contacts configured for contacting each other when said pressure difference in said pressure switch exceeds a threshold value, for actuating said external control device; and a detector testing switch connected between said closed line-type tube and said pressure switch, in fluid communication with said closed line-type tube fluid, and manually operable for generating a pressure pulse in the device, for testing operable condition and status of the device, and for manually activating the device.

2. The detector device of claim 1, wherein said closed line-type tube is constructed of metallic material.

3. The detector device of claim 1, further comprising a detector housing for housing components of the detector device.

4. The detector device of claim 1, further comprising a tube connection adaptor, for enabling connection and disconnection of said closed line-type tube to and from the detector.

5. The detector device of claim 1, further comprising a pressure balancing/equalizing element, in fluid communication with said fluid and surrounding atmosphere, and configured for balancing/equalizing said fluid pressure with pressure of surrounding atmosphere.

6. The detector device of claim 5, wherein said pressure balancing/equalizing element is configured along, and through, a wall of a detector housing.

7. The detector device of claim 1, further comprising a second fluid flow restrictor, configured between said detector testing switch and said pressure switch, and in fluid communication with said closed line-type tube fluid, for restricting fluid flow therebetween.

8. The detector device of claim 1, wherein said pressure switch includes a high pressure port and a low pressure port.

9. The detector device of claim 1, wherein said detector testing switch is configured for being operable in a temperature range of from about minus forty degrees Celsius (−40° C.) to about plus one-hundred and twenty-five degrees Celsius (+125° C.).

10. The detector device of claim 1, further comprising a fixed temperature thermal switch, connected to said detector external connector assembly, for use when the detector operates according to a fixed temperature type detection configuration or mode of operation.

11. The detector device of claim 1, wherein said detector testing switch comprises:

a closed housing containing a gaseous fluid and whose top side is configured with a diaphragm sealing element;

a releasably pushable button assembly affixed upon and through said diaphragm sealing element;

a spring or spring-like element contained inside said housing, and whose first end is affixed to said push button assembly and whose second end is affixed to bottom side of said housing; and a fluid duct affixed along and through said bottom side of said closed housing;

whereby pushing said button assembly increases pressure of said gaseous fluid inside said closed housing, and generates a pressure pulse directed through said fluid duct and into said excessive heat or/and fire detector.

12. The detector device of claim 11, wherein said fluid duct is a duct through which said gaseous fluid is directed and passes from inside of said closed housing and through said detector fluid flow restrictor.

13. The detector device of claim 1, wherein said detector testing switch includes a micro-heater, connectable to, and actuatable by, said external control device.

14. An apparatus for testing operable condition and status of an excessive heat or/and fire detector, the apparatus comprising:

a closed housing containing a gaseous fluid and whose top side is configured with a diaphragm sealing element;

a releasably pushable button assembly affixed upon and through said diaphragm sealing element;

a spring or spring-like element contained inside said housing, and whose first end is affixed to said push button assembly and whose second end is affixed to bottom side of said closed housing; and a fluid duct affixed along and through said bottom side of said closed housing;

whereby pushing said button assembly increases pressure of said gaseous fluid inside said housing, and generates a pressure pulse directed through said fluid duct and into said excessive heat or/and fire detector.

15. The apparatus of claim 14, wherein said fluid duct is a duct through which said gaseous fluid is directed and passes from inside of said closed housing and through a fluid flow restrictor.

16. The apparatus of claim 14, wherein said diaphragm sealing element spans a distance (diameter) of about thirty millimeters (30 mm).

17. The apparatus of claim 14, wherein bottom side of closed housing spans a distance (diameter) of about twenty millimeters (20 mm).

18. The apparatus of claim 14, wherein bottom side of said closed housing to top side of said releasably pushable button assembly spans a distance (height) of about twenty millimeters (20 mm).

19. The apparatus of claim 14, wherein said closed housing is configured from an engineered type plastic.

20. The apparatus of claim 14, wherein said spring or spring-like element is configured and operable for being flexible, and contractable/expandable inside said closed housing.

21. The apparatus of claim 14, wherein said spring or spring-like element is constructed from a flexible (contractable/expandable) metallic material.

22. The apparatus of claim 14, wherein said spring or spring-like element is configured and operable such that the apparatus is capable of generating a pressure pulse within a pre-determined range characterized by a pre-determined lower limit pressure pulse and a pre-determined upper limit pressure pulse.

23. The apparatus of claim 14, wherein said fluid duct is configured for being connected to a fluid flow restrictor via tubing having a length in a range of from about five centimeters (5 cm) to about ten centimeters (10 cm).

24. A system for detecting excessive heat or/and fire, the system comprising:

a detector device comprising:

a closed line-type tube containing a gaseous fluid whose pressure is responsive to variations in temperature, for detecting and sensing a potential condition of excessive heat or/and fire;

a fluid flow restrictor connected to said closed line-type tube, and in fluid communication with said closed line-type tube fluid and surrounding atmosphere;

a pressure switch connected to said closed line-type tube and in fluid communication with said closed line-type tube fluid, and within which a pressure difference is produced in response to a change in pressure of said closed line-type tube fluid;

a detector external connector assembly connected to said pressure switch and connectable to an external control device, and having electrical contacts configured for contacting each other when said pressure difference in said pressure switch exceeds a threshold value, for actuating said external control device; and a detector testing switch connected between said closed line-type tube and said pressure switch, in fluid communication with said closed line-type tube fluid, and manually operable for generating a pressure pulse in the device, for testing operable condition and status of said detector device, and for manually activating said detector device; and a system control device operatively connected to, and in electrical communication with, said detector device.

25. The system of claim 24, wherein said detector testing switch comprises:

a closed housing containing a gaseous fluid and whose top side is configured with a diaphragm sealing element;

a releasably pushable button assembly affixed upon and through said diaphragm sealing element;

a spring or spring-like element contained inside said housing, and whose first end is affixed to said push button assembly and whose second end is affixed to bottom side of said housing; and a fluid duct affixed along and through said bottom side of said closed housing;

whereby pushing said button assembly increases pressure of said gaseous fluid inside said closed housing, and generates a pressure pulse directed through said fluid duct and into said detector device.

* * * * *